United States Patent [19]

Ragland, Jr.

[11] Patent Number: 4,615,205

[45] Date of Patent: Oct. 7, 1986

[54] FORMING A SHADOW MASK FROM A FLAT BLANK

[75] Inventor: Frank R. Ragland, Jr., Lancaster, Pa.

[73] Assignee: RCA Corporation, Princeton, N.J.

[21] Appl. No.: 621,382

[22] Filed: Jun. 18, 1984

[51] Int. Cl.[4] ..... B21D 22/00

[52] U.S. Cl. ..... 72/347; 72/348

[58] Field of Search ..... 72/347–349, 72/345, 344

[56] References Cited

U.S. PATENT DOCUMENTS 3,195,341 7/1965 Zurnich ..... 72/345

3,296,850 1/1967 Fiore .

3,621,699 11/1971 Valek ..... 72/348

*Primary Examiner*—Leon Gilden

*Attorney, Agent, or Firm*—E. M. Whitacre; D. H. Irlbeck; T. H. Magee

[57] ABSTRACT

A punch and pad for forming a square planar shadow mask have curved outer edges. A pair of dies respectively receiving the punch and pad have straight inner edges. The dies clamp a flat shadow mask blank and the punch is lowered to only partially form the shadow mask. The mask is then unclamped and the punch is fully lowered towards the pad to complete the forming of the mask without wrinkles.

6 Claims, 14 Drawing Figures

FORMING A SHADOW MASK FROM A FLAT BLANK

BACKGROUND OF THE INVENTION

The present invention relates to a method and an apparatus for forming a shadow mask for a color cathode ray tube (CRT), and more particularly, to such method and apparatus for forming a shadow mask for a square planar (SP) CRT.

A shadow mask is a perforated conducting sheet disposed behind a CRT faceplate having a similar contour as the faceplate, for the purpose of permitting three electron beams to land only on respective color-emitting phosphors deposited on the faceplate. Typically, a conventional spherical shadow mask is formed from a blank by first clamping the blank around its periphery with a clamping means between a pad and a punch. The pad and the punch are shaped with a contour to give the desired mask contour, i.e. allowance is made for spring-back after forming. The punch is then brought towards said pad stretching the blank to give it the desired mask contour.

Recently, interest has been directed at the "square planar" CRT, such as shown in U.S. application Ser. No. 469,774, filed Feb. 25, 1983, in the name of the present inventor and under common assignment herewith. This application discloses a CRT having different faceplate curvatures along its major and minor axes. This results in a planar edge for the faceplate resulting in a flatter appearance of the tube screen. The shadow mask for such square planar tube also has substantially different curvatures along its major and minor axes. When the above technique for forming shadow masks is used for the square planar tube shadow masks, wrinkles, due to excess material, occur near the ends of the major (long) axis, i.e., along the short sides of the mask. The reason for this is that near the ends of the major axis the curvature is nearly straight in a direction parallel to the minor axis. Since the ends along the short sides are held by curved dies, the mask blank is now curved. When trying to press the curved blank into a straight shape, there is exces material present and hence wrinkles.

SUMMARY OF THE INVENTION

The present invention overcomes the above problem of wrinkling. An apparatus according to the invention comprises a punch and a pad, each having the same peripheral contour, and a pair of dies which respectively receive the punch and pad. The dies each have a different peripheral contour from the peripheral contour of the punch and pad. A method in accordance with the invention comprises partially punching the mask while the mask is clamped by the dies. The mask is then unclamped and the punching operation is completed.

DETAILED DESCRIPTION

Figure 1:
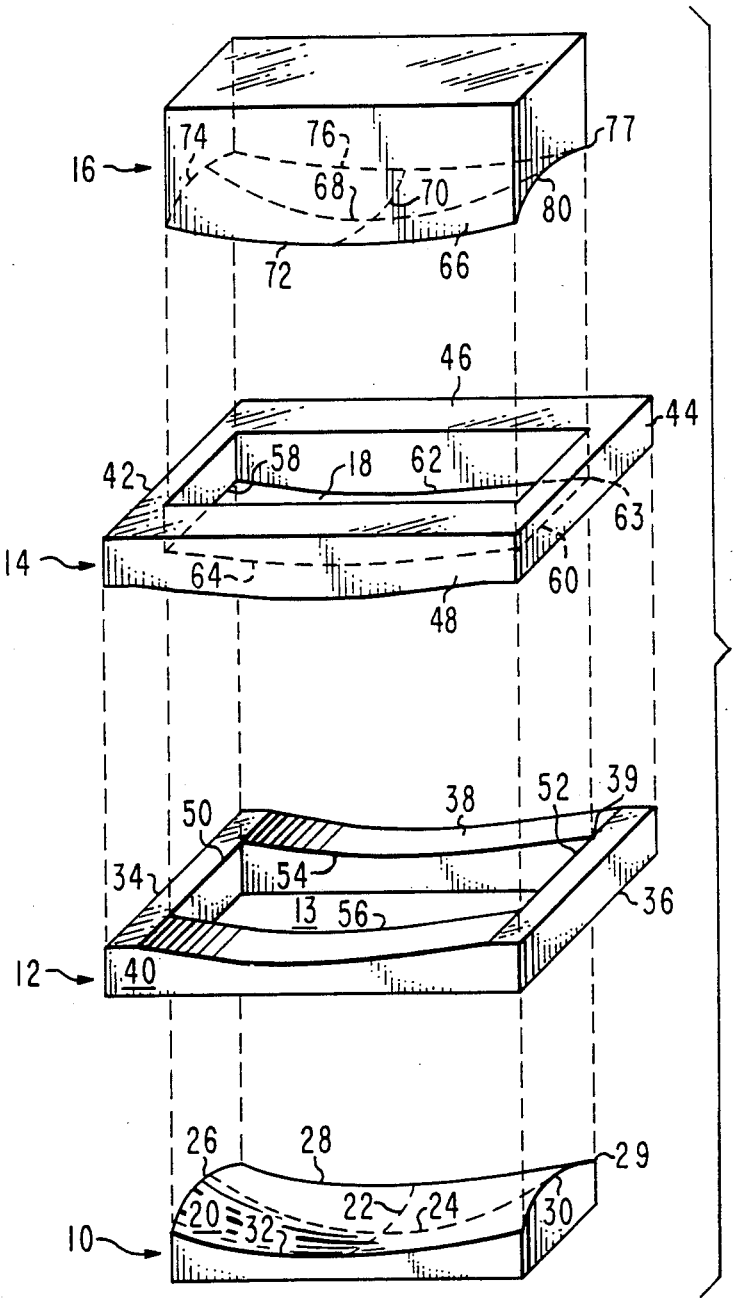
FIG. 1 is an exploded isometric view of a punch, pad, and pair of dies in accordance with the invention.

FIG. 1 shows (progressing from the bottom to the top) a pad 10, a lower die 12 that receives the pad 10 in a central aperture 13 thereof, an upper die 14, that mates with the lower die 12, and a punch 16 that is received in a central aperture 18 of the upper die 14. Elements 10, 12, 14 and 16 preferably are made of steel. The elements 10 and 16 have a 4:3 aspect ratio for forming a conventionally proportioned shadow mask. Other aspect ratios such as 5:3 or 2:1 can be used. "Aspect ratio" is the ratio of width to height of the shadow mask when in its normal vertical position in a CRT. It will be appreciated that for the sake of clarity various details of elements 10, 12, 14 and 16 such as holes for receiving pins to locate the shadow mask and threaded holes for receiving bolts to secure these elements to a press (not shown), all as known in the art, have been omitted. The press can be a 200 ton model manufactured by Watson-Stillman. Presses made by other manufacturers can be used.

The pad 10 has a concave top surface 20 that is curved in two dimensions as indicated by the curved dotted lines 22 and 24. Edges 26 and 30 of the pad 10 are convex curved, while edges 28 and 32 are concave curved. Since line 22 is concave curved, while edges 26 and 30 are convex curved, two reversals of curvature (i.e. nearly straight lines) parallel to the minor axis near the short sides are preset. Edges 26, 28, 30 and 32 define the peripheral contour of the pad 10.

The lower die 12 comprises side sections 34 and 36 having substantially straight tops (as contrasted with the curved tops of the prior art) and side sections 38 and 40 having concave curved tops. Inner top edges 50, 52, 54 and 56 of the side sections 34, 36, 38 and 40, respectively, define an inner edge peripheral contour of the die 12.

The upper die 14 comprises side sections 42 and 44 having substantially straight bottoms (as contrasted with the curved bottoms of the prior art) and side sections 46 and 48 having convex curved bottoms with a curvature that matches that of the top of the side sections 38 and 40 of the die 12. Thus the dies 12 and 14 can be placed together without any space therebetween (assuming the shadow mask is not present). Inner bottom edges 58, 60, 62 and 64 of the side sections 42, 44, 46 and 48 define an inner edge peripheral contour for the die 14.

The punch 16 comprises a convex bottom surface 66 that is curved in two dimensions as indicated by the curved lines 68 and 70. The curvature of the lines 68 and 70 matches that of the lines 24 and 22, respectively, of the top surface 20 of the pad 10. Thus the punch 16 and the pad 10 can be placed together without any space therebetween (assuming that a shadow mask is not present). Edges 72, 74, 76 and 80 define the peripheral contour for the punch 16. Side edges 74 and 80 are concaved curved, while front edge 72 and back edge 76 are convexed curved.

Figure 2:
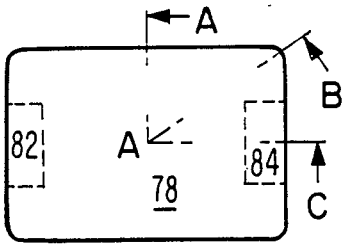
FIG. 2 is a front view of a mask blank showing lines where various cross-sections are taken.

FIG. 2 shows a mask blank 78, which is made of steel. As known in the art, the mask blank 78 has apertures such as elongated slots (not shown) or circular holes (not shown) for color selection purposes. The minor axis is denoted A-A, the diagonal A-B, and the major axis A-C. When using a prior art machine having the tops of the side sections 34 and 36 curved and the bottoms of the side sections 42 and 44 curved to form an SP shadow mask, wrinkling of the shadow mask would occur approximately in the areas denoted by 82 and 84. The reason for this is that these areas are curved by the curved tops and bottoms of the side sections, while that portion of areas 82 and 84 that are away from the edges are being deformed into a nearly straight line, thereby resulting in excess material which wrinkles.

Figure 3:
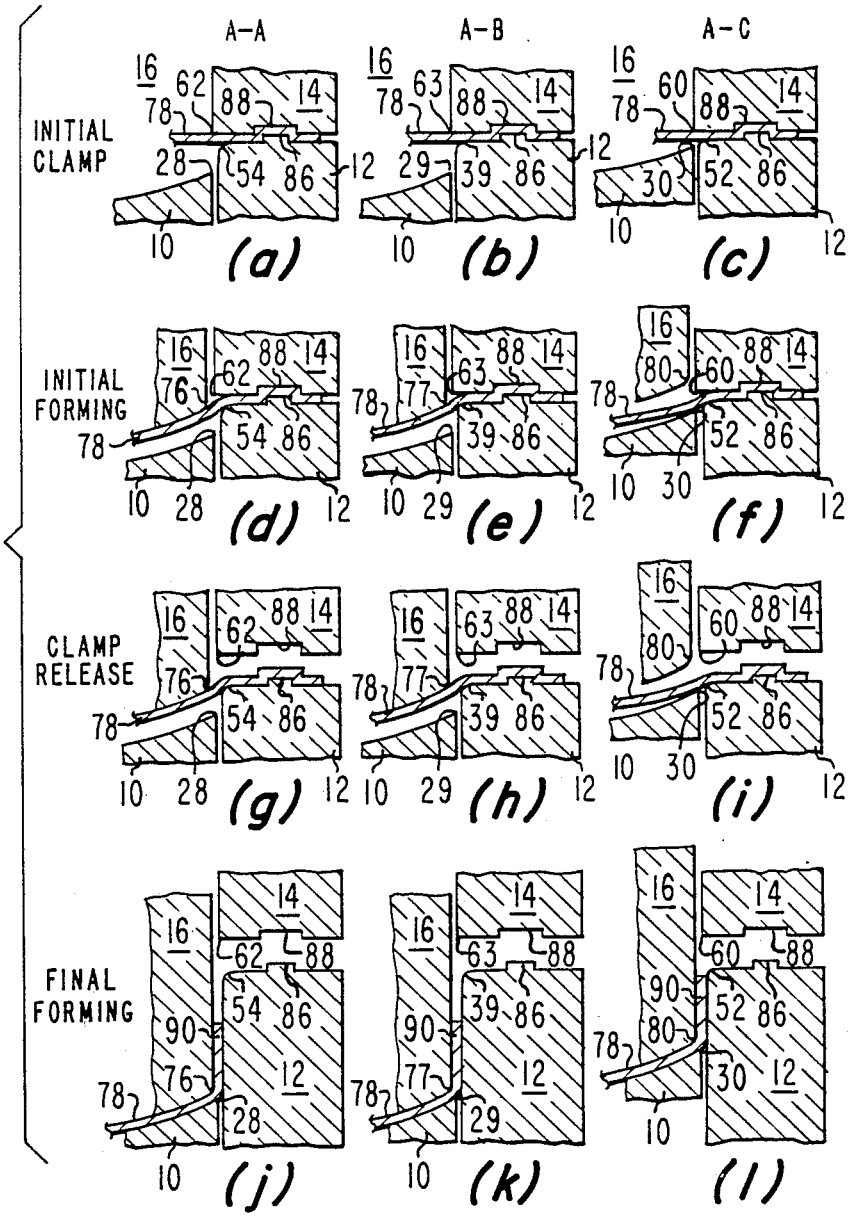
FIGS. 3(*a*) to 3(*l*) show cross-sectional views taken along the lines of FIG. 2.

FIG. 3 shows cross-sections taken along the minor axis, the diagonal and the major axis near the edge of the shadow mask during different stages of the shadow mask forming process. It will be appreciated that the diagonally opposed edges have the same appearance. In particular, FIGS. 3(*a*), (*d*), (*g*), and (*j*) are taken along the minor axis A-A, FIGS. 3(*b*), (*e*), (*h*) and (*k*) are taken along the diagonal axis A-B, and FIGS. 3(*c*), (*f*), (*i*), and (*l*) are taken along the major axis A-C. It will be seen that the dies 12 and 14, respectively, have a tongue 86 and a complementary groove 88 in order to secure the mask blank 78. These elements are not shown in FIG. 1 for simplicity.

FIGS. 3(*a*), (*b*), and (*c*) show the operation during an initial clamping step. The flat mask blank 78 is placed on the lower die 12 and the upper die 14 is brought down by the press (not shown) to tightly clamp the flat mask blank 78 between the lower die 12 and the upper die 14. A bead is formed in mask blank 78 by the tongue 86 and the groove 88. FIG. 3(*c*) shows that the edge 30 of the pad 10 is nearly even with the edge 52 of the die 12, but the edge 28 and a corner 29 are below the die edge 54 and a corner 39, respectively as shown in FIGS. 3(*a*) and (*b*). The punch 16 is not seen in this step since it is well above the pad 10.

FIGS. 3(*d*), (*e*), and (*f*) show the operation during an initial forming step. As shown in FIG. 3(*e*) with the mask 78 clamped between the upper die 14 and the lower die 12, the punch 16 is downwardly forced into the flat mask blank 78 by the press until the punch 16 just enters the die 12 at the corner 39. Since the punch 16 and the lower die 12 have the same peripheral contours along the long sides, i.e. the curvature of the edge 76 matches that of the edge 54, the punch 16 also just enters the die 12 along the long sides, as shown in FIG. 3(*d*). FIG. 3(*f*) shows that on the short sides the punch 16 does not enter the die 12 because of the difference in the peripheral contours of the punch 16 and the lower die 12 along the short sides, i.e. the edge 80 is above the edge 52 due to the curvature of edge 80. Therefore, the areas 82 and 84 near the ends of the major axis are not yet formed. This initial forming step forms about 90% of the contoured area of the mask 78. Since the short sides of the mask blank 78 are held by the straight top edges 34 and 36 of the die 12 and the straight bottom edges 42 and 44 of the die 14, then when the mask 78 is formed into the contour of the punch 16, there is no excess material at the area of the reversal of curvature, and therefore no wrinkling.

FIGS. 3(*g*), (*h*), and (*i*) show the details of a clamp release step. With the punch 16, the lower die 12, and the pad 10 in the same relative positions as in the previous step, the upper die 14 is upwardly withdrawn by the press about 2 mm.

FIGS. 3(*j*), (*k*), and (*l*) show the final forming step. The punch 16 is downwardly forced by the press further into the mask blank 78 and the lower die 12 to complete the forming of the contoured area of the mask blank 78 in the areas 82 and 84, which is done without wrinkles since the periphery of the mask is no longer secured by the dies 12 and 14. The mask skirt 90 is also formed and the bead is removed. The punch 16 is then moved up by the press and the formed mask is removed.

What is claimed:

1. Apparatus for forming a shadow mask having short and long sides, said apparatus comprising:

a punch having a peripheral contour;

a pad having said contour and disposed opposing said punch;

a pair of dies for respectively receiving said punch and pad, each die having an inner edge peripheral contour along at least a short side thereof different from the peripheral contour of said punch and pad.

2. Apparatus as claimed in claim 1, wherein said dies each have a straight inner edge peripheral contour along said short sides thereof and said punch and pad each have an arcuate peripheral contour along the short sides thereof.

3. Apparatus as claimed in claim 2, wherein said arcuate peripheral contour of said punch along said short side is concave and said arcuate peripheral contour along said short side of said pad is convex.

4. Apparatus for forming a shadow mask having short and long sides, said appparatus comprising:

an at least partially convex punch having a concave outer edge contour along short sides thereof;

an at least partially concave pad having a convex outer edge contour along short sides thereof and disposed opposing said punch;

and a pair of dies for respectively receiving said punch and pad and each having a flat inner edge contour along two opposing short sides thereof.

5. A method of forming a shadow mask comprising:

clamping a shadow mask blank having apertures around the periphery thereof;

punching said mask blank to partially form a surface of said mask having apertures into a desired contour;

unclamping said mask; and punching said surface having apertures to complete forming said mask into said desired contour.

6. A method as claimed in claim 5, further comprising:

forming a skirt on said mask.

* * * * *